US006019277A

United States Patent [19]

Lundström

[11] Patent Number: 6,019,277

[45] Date of Patent: Feb. 1, 2000

[54] BEVERAGE CONTAINER AND BOTTOM CLOSURE THEREFORE

[75] Inventor: Jan-Inge Lundström, Västerås, Sweden

[73] Assignees: Bjorn Elfvin, Stockholm; Rolf Lundstrom, Vasteras, both of Sweden

[21] Appl. No.: 08/973,326

[22] PCT Filed: May 29, 1996

[86] PCT No.: PCT/SE96/00691

§ 371 Date: Feb. 2, 1998

§ 102(e) Date: Feb. 2, 1998

[87] PCT Pub. No.: WO96/38343

PCT Pub. Date: Dec. 5, 1996

[30] Foreign Application Priority Data

May 29, 1995 [SE] Sweden ..... 9501845
Apr. 15, 1996 [SE] Sweden ..... 9601425

[51] Int. Cl.[7] ..... B65D 5/36

[52] U.S. Cl. ..... 229/117.05; 229/113; 229/103.1; 229/155; 229/183

[58] Field of Search ..... 229/103.1, 113, 229/117.05, 117.06, 155, 164, 183; 206/459.5

[56] References Cited

U.S. PATENT DOCUMENTS

| | | | |
|---|---|---|---|
| 801,579 | 10/1905 | Flora et al. | 229/184 |
| 1,088,964 | 3/1914 | Buchman | 229/155 |
| 2,119,382 | 5/1938 | Cooper | 229/113 |
| 2,220,746 | 11/1940 | Wentz | 229/103.1 |
| 2,761,609 | 9/1956 | Arkin | 229/117.06 |
| 3,032,252 | 5/1962 | Hill | 229/183 |
| 3,049,281 | 8/1962 | Vines | 229/145 |
| 3,144,192 | 8/1964 | Seline, Jr. | 229/183 |
| 3,279,679 | 10/1966 | Engelsher et al. | 229/103.1 |
| 4,471,904 | 9/1984 | Cassidy | 229/117.05 |
| 4,560,102 | 12/1985 | Dlugopolski | 206/459.5 |
| 4,848,589 | 7/1989 | Olson et al. | 229/136 |
| 4,850,528 | 7/1989 | Hanus | 229/155 |
| 5,458,270 | 10/1995 | Tsao | 229/155 |
| 5,492,269 | 2/1996 | Sung | 229/117.06 |

FOREIGN PATENT DOCUMENTS

| | | | |
|---|---|---|---|
| 428869 | 5/1935 | United Kingdom | 229/113 |

*Primary Examiner*—Gary E. Elkins
*Attorney, Agent, or Firm*—Pillsbury Madison & Sutro LLP

[57] ABSTRACT

The invention relates to a collapsible beverage container produced froma foldable sheet-like blank and provided with a closed bottom and sidewalls upstanding from the bottom. Integrated with the side walls in an extension thereof are inwardly foldable container closing top flaps. The sheet-like blank may also include a drinking tube forming part which cna be folded into a drinking tube at one corner of the container. The invention also relates to a bottom closure suitable for a beverage container, among other things.

15 Claims, 3 Drawing Sheets

BEVERAGE CONTAINER AND BOTTOM CLOSURE THEREFORE

This application is the national phase of international application PCT/SE96/00691, filed May 29, 1996 which designated the U.S.

The present invention relates to a beverage container which is intended for use in serving beverages and which can be readily filled with the beverage to be served in a service locality and thereafter readily closed. The invention also relates to a bottom closure for a beverage container, particularly a package container, intended to hold powder or liquid material, or a beverage package, said bottom closure being particularly usable with a container produced from sheet material.

In hamburger bars and like establishments, beverages are at present normally served in a round mug having a conically upwards and outwards sloping side wall. These mugs are also used with loose lids that can be fitted over the upper rim of the mug. The lid may also be provided with a weakening in the centre of the lid through which a drinking tube, or drinking straw, can be pushed into the mug and therewith into the contained beverage without needing to remove the lid.

One drawback with mugs of the aforedescribed kind is that when filled they have a relatively high centre of gravity which renders the mug unstable, and the aforesaid lid when fitted to the mug is not effective in preventing the beverage from leaking from the container should the container topple over. This is because the container has a relatively tin wall and is therewith easily deformed when it topples, such as to loosen the lid so that the container contents are able to run out.

In the case of package containers or beverage containers which, e.g., are not filled at the time of manufacturing the container with the substance that is to be at least temporarily stored therein, it must be possible to be able to transport and store the containers in a space-preserving manner. It is necessary to find solutions to the transportation and storage problems, particularly in the case of containers that cannot be readily stacked or nested one within the other. One solution would be to provide a foldable container, although the container bottom closure may then cause a problem, particularly when the number of mutually superposed layers of material in the folded container shall not be excessively large.

A first object of the present invention is to provide a novel beverage container in which beverages can be served and which is not encumbered with the aforesaid drawbacks and thus is less liable to topple when filled and with which the contents thereof are less liable to be emptied should the container topple nevertheless.

Another object of the invention is to provide a container of the aforesaid kind which can be handled easily when storing, filling and closing the container.

A further object of the invention is to provide a beverage container of the aforesaid kind which can be readily manufactured, preferably from an environmentally friendly material.

Yet another object of the invention is to enable container, drinking tube and lid to be produced from one single blank.

Still another object of the present invention is to provide for a container of the aforesaid kind a bottom closure which can be readily manufactured in a cost-effective and material-effective manner.

Yet another object of the invention is to provide a bottom closure which when the container is erected or developed from its blank form will contribute to maintaining the container in its erected state and not strive to return to its folded state.

Another object of the invention is to provide a beverage container having a bottom closure in accordance with the invention.

These objects of the invention have been achieved with a beverage container and a bottom closure that have the characteristic features set forth in respective claims.

The invention will now be described with reference to exemplifying embodiments thereof and also with reference to the accompanying drawings, in which FIG. 1 is a view showing an inventive beverage container blank from above;

Figure 1:
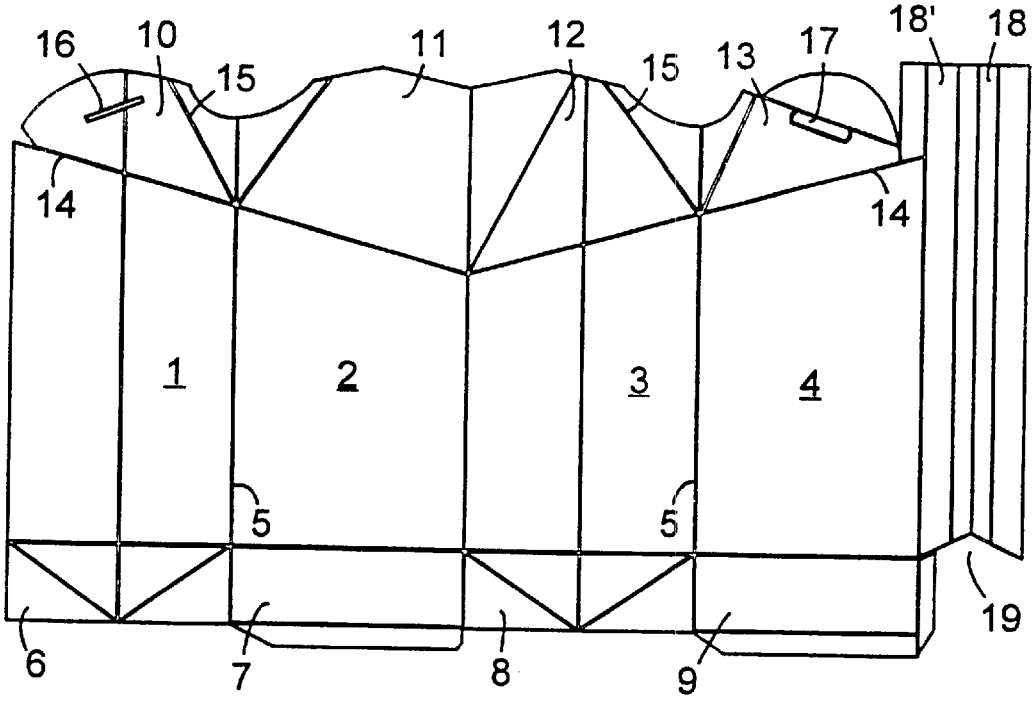

Thus, FIG. 1 illustrates a blank from which a beverage container having a square bottom surface can be erected. The blank includes four side walls 1, 2, 3 and 4, of which walls 1 and 2, 2 and 3, 3 and 4 can be folded in relation to one another with the aid of associated fold lines 5 which form the corners of the container or package. The side wall 1 can be affixed to the side wall 4 by gumming the tree end of the side wall 1 firmly to a flap at the outer end of the side wall 4, in a known manner. As will be seen from FIG. 1, appended to the bottom of the side walls are bottom flaps 6, 7, 8 and 9, which are intended to be folded-in and gummed to one another to form a container having a closed and sealed bottom.

As shown in FIG. 1, the upper ends of respective side walls are adjoined to top flaps 10, 11, 12 and 13, which are direct extensions of the side walls. The top flaps can be folded in relation to the side walls along fold lines 14. These fold lines do not extend perpendicular to the fold lines 5 that delimit the side walls 1, 2, 3 and 4, but extend at an angle from the outer edges downwardly so as to meet in a lowest point on the fold line 5 between the side walls 2 and 3, as shown in FIG. 1. The top flaps also have fold lines which are extensions of the fold lines 5 delimiting the side walls, and each top flap also has at least one further fold line 15 that extends obliquely from the intersection point of the fold line 5 with the fold line 14, so as to provide a further possibility of folding together each of the top flaps. The top flaps also have a backwards and forwards meandering upper edge which is configured to enable the flaps to be easily folded-in one over the other. When the package or container is erected, the top flaps are locked in a closed state by means of a tongue 17 provided on the top flap 13 and a slot 16 provided on the top flap 10 wherein the tongue 17 is inserted into the slot 16 and therewith lock the top flaps together and seal the container.

The illustrated blank is also provided on the free edge of the side wall 4 with a lateral extension that forms a so-called drinking tube. The drinking tube 18 is formed by folding said lateral extension along fold lines that extend parallel with the fold line 5. The drinking tube 18 is then gummed together in the same way as the remainder of the container. That part 18' of the drinking tube 18 lying proximal to the side wall 4 also functions as a gumming flap for the side wall 1 when the container is to be gummed together. As will be seen from FIG. 1, the upper edge of the drinking tube blank extends roughly to the same height as the uppermost edges of the top flaps 10–13. However, the bottom end of the drinking tube blank 18 terminates at the point at which the side walls merge with the bottom parts, so that the drinking tube will not be longer than the side walls. The blank also includes a triangular aperture 19 which provides an opening inwardly towards the drinking tube adjacent the bottom of the container when the container is closed and filled with beverage, so that beverage is able to enter the drinking tube.

Figure 2:
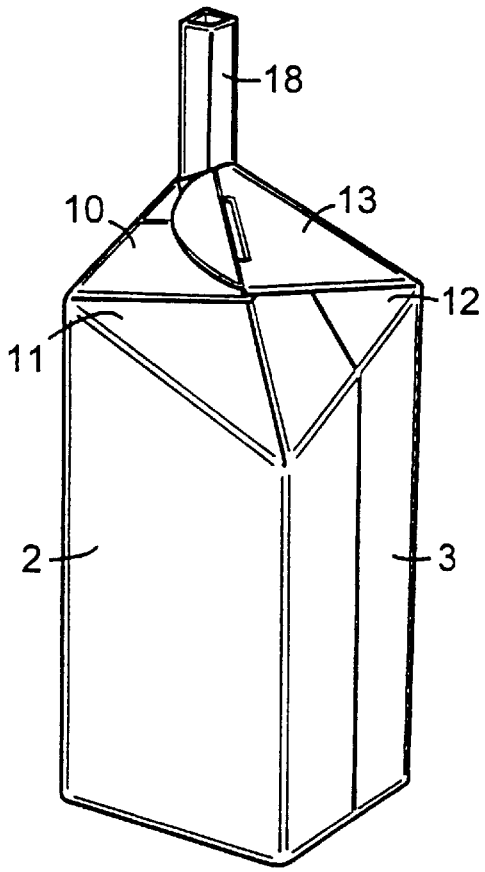
FIG. 2 shows a beverage container folded to an erected state from the blank shown in FIG. 1.

The blank shown in FIG. 1 can be folded together to form a container having upstanding side walls, essentially in the way shown in FIG. 2, although with the top flaps not closed but extending upwardly as extensions of the side walls. The container can then be filled in this open state with the beverage to be served and thereafter immediately sealed by folding-in the top flaps in the aforedescribed manner and sealing the container to form the closed container shown in FIG. 2.

When the container is erected with its upper end open, the container can be folded along the folding lines delimiting the side walls 1 and 3 to an essentially flat state in which it can be transported and stored in a space-saving manner.

Figure 3:
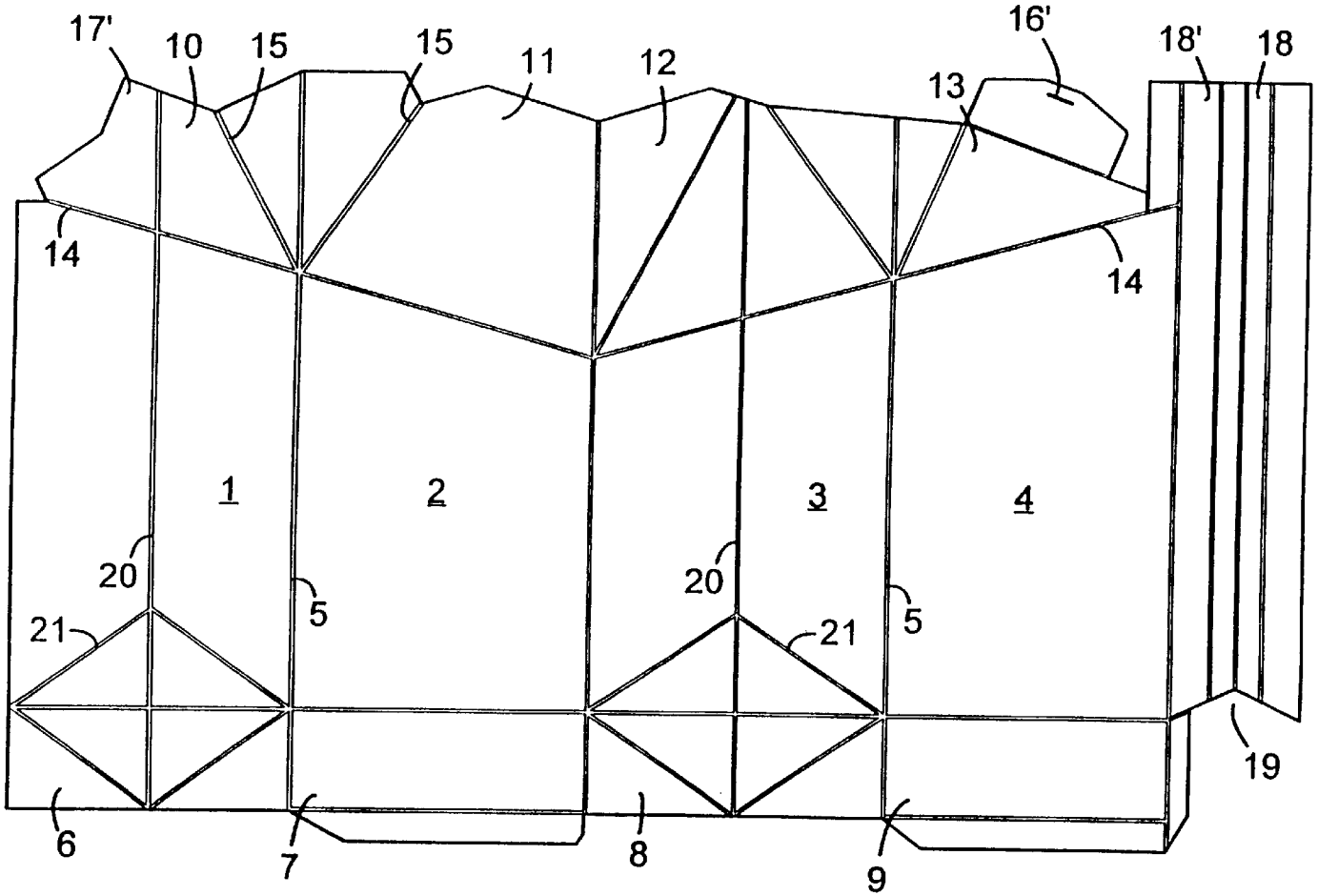
FIG. 3 illustrates a blank variant from which a beverage container essentially similar to that shown in FIG. 1 can be erected.

FIG. 3 shows a variant of an inventive beverage container blank which differs slightly from the container described with reference to FIGS. 1 and 2. The main difference between the FIG. 1 and FIG. 3 embodiments is found in the configuration of the upper edge of the top flaps, which has a slightly different appearance and where the differences primarily lie in how the locking flap and its co-acting aperture or slot are arranged. In the case of the FIG. 3 embodiment, the top flap 13 includes a slot 16' while the top flap 10 includes a locking flap 17' which coacts with the slot or aperture 16'. The locking flap 17' has the form of a corner which projects out from the upper edge of said top flap. One advantage with this configuration of the top flaps is that when closing the container the flaps can be folded-in from left to right or from right to left from the drinking tube 18, depending on the design. Another advantage with this embodiment is that locking of the top flaps is improved and more secure.

The top flaps have also been configured to enable the mutually covering top flaps to be folded in one or the other direction, thus with the first or the second covering the second or the first. This enables the two top flaps to be provided with different markings such that one or the other marking can be made visible by folding the flaps in one or the other direction. This is particularly beneficial when serving beverages that are available in different variants, for instance a conventional beverage and a beverage of lower calory content, for which the marking "light" can be made visible in those instances when the container is filled with this beverage variant.

As will be seen from FIG. 3, the side walls 1 and 3 of this embodiment are provided centrally thereof with further fold lines 20 which extends parallel with the fold lines 5, and bottom fold lines 21 which extend obliquely upwards from the respective bottom flaps from the outside of respective side walls and towards the further fold lines. This design of the side walls 1 and 3 enables a container formed in accordance with the embodiment shown in FIG. 3 to be folded into a flat packet, by folding-in the container bottom at the same time as the side walls 1 and 3 are folded in the centre thereof, so that the side walls 2 and 4 will essentially lie against one another with the side walls 1 and 3 and the bottom parts folded-in therebetween. This provides a highly space-saving container which, when it is to be filled, an be easily opened by gripping the outer edges of the two side walls 2 and 4 and drawing up the container. According to this embodiment, if a container is not fully erected to an extent in which the bottom is flat, the container will nevertheless be stable because the container will rest at least on the bottom edges of two opposing side walls and on all four of its corners.

In a further embodiment not shown in any of the Figures, the drinking tube may be provided with a closure part by virtue of an upper part which is closed when the drinking tube blank is folded to form a drinking tube and which has a tear line provided therebeneath. This embodiment provides a closed drinking tube, whereby the filled container will be essentially fully sealed with less risk of leakage should the container topple over.

The inventive container can be produced from any appropriate material, such as from liquid impervious paperboard or the like, for instance.

The stability of the container can be further enhanced by configuring the container side walls with slightly swung side-edges, whereby the opened and extended container will not strive to return to its earlier folded state.

The earlier known bottom closure described above has, however, been bound unsuitable for beverage containers of the aforesaid kind in some instances, and consequently it had been found necessary to provide a novel bottom closure to reduce the thickness of the collapsed or folded beverage container.

Figure 4:
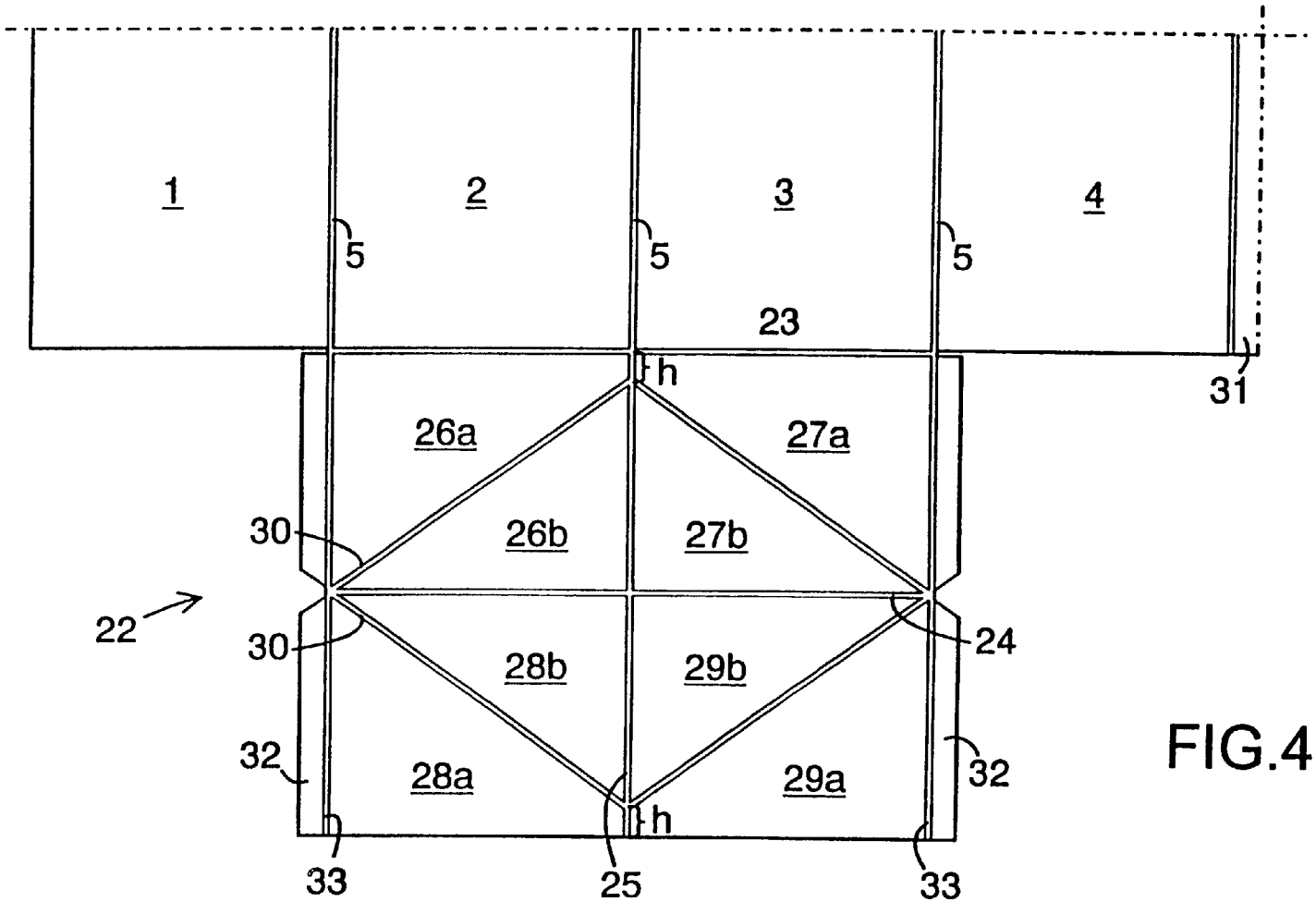
FIG. 4 is a view showing from above a blank from which a container having the novel bottom closure according to the invention can be erected.

FIG. 4 illustrates a bottom closure for a beverage container according to FIG. 2, there being shown solely the bottom part of side walls and a bottom flap adjoined thereto as a single unit for forming the bottom closure of the container to be constructed from the blank, since the upper part of the blank and the configuration of the upper part of the container are essentially irrelevant to the present invention. With the exception of the bottom part, the blank may have the same design and the blank shown in FIG. 4 or in FIG. 3. The blank includes four side walls 1, 2, 3 and 4, which can be folded in relation to one another along fold lines 5, at which the corners of the container are formed. The bottom flap 22 adjoins the lower edge of the two side-wall parts 2 and 3 along a fold line 23. The bottom flap 22 has a further fold line 24 which extends parallel with the fold line 23 midway of the extension of the bottom flap 22 from the side flaps 2, 3. The bottom flap 22 also has centrally thereof a fold line 25 which forms an extension of the fold line 5 between the side-wall parts 2 and 3. The bottom flap 22 is divided by the fold lines 23, 24 and 25 into four rectangular parts 26, 27, 28 and 29 of equal size. These rectangular parts 26–29 are, in turn, each divided into two parts 26*a*, 26*b*, 27*a*, 27*b*, 28*a*, 28*b*, 29*a* and 29*b* by obliquely extending fold lines 30 that pass from the outer edges of the bottom flap 22 at the central fold line 24 towards the side flaps 2, 3 and towards the bottom edge of the bottom flap 22 and the fold line 9 respectively.

The container is erected or developed by folding the bottom flap 22 in towards the wide walls 2, 3 along the fold line 7, and, at the same time, folding back along the fold line 24 so that only the parts 26 and 27 will lie against the side walls 2 and 3, whereas the parts 28 and 29 lie on top of the parts 26 and 27, whereafter the side walls 1 and 4 are folded-in over the side walls 2 and 3 such as to lie against the parts 28 and 29 respectively. The bottom is secured by gumming the triangular part 26*a* to the side wall 2, gumming the triangular part 27*a* to the side wall 3, gumming the triangular part 28*a* to the side wall 1, and gumming the triangular part 29*a* to the side wall 4. The side walls are also gummed together in a known manner, with the aid of a flap 31 on the side wall 4, this flap 31 being gummed to the side wall 1. There is obtained in this way a collapsed (flattened) container provided with a bottom closure integral with the container. The container is erected to enable it to be filled with beverage or substance, by pressing the outer edges at the fold lines between the side walls 1 and 2 and side walls 3 and 4 respectively towards each other, so that the container and its bottom closure can be folded-out, wherein the triangular parts 26*b*, 27*b*, 28*b* and 29*b* will be folded away from their corresponding triangular parts 26*a*, 27*a*, 28*a* and 29*a* along the fold lines 30 to form a trough-like bottom in the container with the deepest part of the trough along the fold line 9.

The bottom can be made particularly stable by causing the fold lines 30 to extend to a point on the fold line 25 located at a distance h, about 5 mm, from the fold line 23 and the outer edge of the bottom flap respectively. In this way, that part of the bottom flap along the distance h on the fold line 25 will also be firmly gummed to the side walls when gumming the container together, said bottom being drawn inwardly from the bottom edges of the side walls 1–4.

As shown in the Figure, the bottom flap 22 may also be provided with side flaps 32 outwardly of the parts 26, 28 and 27, 29 respectively and formed integrally therewith and delimited therefrom by means of fold lines 33. When folding the bottom flap 22 in against the side walls 1–4, as described above and thereafter gumming, the side flaps will also be gummed together in the corners between the respective side walls 1, 2 and 3, 4. These side flaps contribute towards sealing the bottom of the container and are particularly suitable in containers which are intended to hold liquid substances, for instance beverage containers.

The container may be conveniently be produced from paper sheet coated with polyethylene, wherewith gumming of the container can be effected by heating those parts, surfaces, which are to be bonded together. In order to further reduce the risk of leakage from the container bottom when the container is to be used as a beverage container, it may be necessary to provide an extra glue point at the upper inwardly folded corners of the bottom flap 22 before folding the side walls 1 and 4 over the bottom flap to gum the bottom flap to the side walls.

Naturally, the bottom closure can be used for other types of containers and packaging units in which the bottom piece is integral with the remainder of the container/packaging unit. It will also be understood that materials other than those mentioned can be used.

Further modifications can be made to the inventive container and the inventive bottom closure without departing from the inventive concept as defined in the following claims.

I claim:

1. A collapsible beverage container produced from a foldable sheet blank and provided with a closed bottom and side walls (1–4) upstanding therefrom, the container being delivered in its collapsed state and erected manually by the user or server, wherein the bottom is formed by a bottom flap (22) formed integrally with the sheet material forming said side walls (1–4), said bottom flap being folded double and placed against the lower parts of two of the side walls (2, 3) with the other two side walls (1, 4), placed on top of the double-folded bottom flap, characterized in that triangular parts (26*a*, 27*a*, 28*a*, 29*a*) of the bottom flap (22), lying wih their bases in parallel with a fold line (24) intersecting the bottom flap in parallel with the bottom wall of the blank and essentially midway of the extension of the bottom flap from the bottom of the blank and having their apexes towards this fold line (24), are each joined to a respective side wall (1–4) so as to form a closed bottom.

2. A container according to claim 1, characterized in that the triangular bottom-flap parts (26*a*, 27*a*, 28*a*, 29*a*) by gumming or heat-bonding are secured to the side walls (2, 3, 1, 4).

3. A container according to claim 1, characterized in that a point of glue is provided at the upper inwardly folded corners of the bottom flap (22).

4. A container according to claim 1, characterized in that the triangular parts (26*a*, 27*a*, 28*a*, 29*a*) of the bottom-flap cover the entire width of the bottom-flap (22).

5. A container according to claim 1, characterized in that that the triangular parts (26*a*, 27*a*, 28*a*, 29*a*) of the bottom-flap with essentially their entire triangular areas are joined to a respective sidewall (1–4).

6. A container according to claim 1, characterized in that an edge-part (32) on each side of the bottom flap (22) extends slightly further out than the extension of the side walls (2, 3) with which the bottom flap is joined, and that the edge flaps (32) are joined together to form a tight corner.

7. A container according to claim 1, characterized in that the bottom is drawn up from the bottom edge of the container side walls (1–4).

8. A container according to claim 6, characterized in that the edge flaps (32) are delimited from the bottom parts of the bottom flap by a fold line (33) which is located inwardly of the corresponding fold line (5) that delimits the side walls (1, 2; 3, 4).

9. A container according to claim 1, characterized in that foldable container closing top flaps (10–13) are provided integral with the side walls (1–4) in the extension of said walls, and that the inwardly foldable top flaps (10–13) have a shape and size such that in their inwardly folded state they will at least partially overlap one another, and are configured in a manner which will enable them to be easily joined together to close the container by the user or a server.

10. A container according to claim 9, characterized in that at least one of the inwardly foldable top flaps has formed integrally therewith locking means (16, 17; 16', 17') by means of which the top flaps can be secured to one another in their inwardly folded state.

11. A container according to claim 9, characterized in that the top flaps (10–13) are provided with different beverage identifying markings; and in that the top flaps (10–13) can be folded in different mutual order to present a marking which is indicative of the nature of the beverage contained.

12. A container according to claim 1, characterized in that the container has a square bottom; and in that the side walls (1–4) are configured such that the upper edge of said walls slopes upwards from one corner of the container to the opposite corner thereof such that in their inwardly folded state said top flaps will form a sloping rhomboidal surface.

13. A container according to claim 12, characterized in that the inwardly folded top flaps (10–13) are formed by extensions of the side walls (1–4) and each has a fold line (15) that extends towards the extension of the side-wall corner.

14. A container according to claim 1, characterized by a drinking tube (18) formed by folding together a blank part located on one side of a side wall (4).

15. A container according to claim 13, characterized in that the drinking tube (8) is located in the corner of the container where the container is highest.

* * * * *